US010689918B2

(12) United States Patent
Barton et al.

(10) Patent No.: US 10,689,918 B2
(45) Date of Patent: Jun. 23, 2020

(54) RETRIEVABLE RE-CONNECTING DEVICE WITH INTERNAL SEAL AND SLIPS FOR CONNECTING TO THE TOP OF AN EXISTING TUBING IN A WELL BORE

(71) Applicant: VANGUARD OIL TOOLS & SERVICES LLC, Muscat (OM)

(72) Inventors: Len Barton, Annaberg Lungotz (AT); Mats Johansson, Gallivare (SE); Borre Loviknes, Nordfjordeid (NO)

(73) Assignee: Vanguard Oil Tools & Services LLC, Muscat (OM)

( * ) Notice: Subject to any disclaimer, the term of this patent is extended or adjusted under 35 U.S.C. 154(b) by 255 days.

(21) Appl. No.: 15/525,423

(22) PCT Filed: Nov. 17, 2015

(86) PCT No.: PCT/IB2015/058870
§ 371 (c)(1),
(2) Date: May 9, 2017

(87) PCT Pub. No.: WO2016/079664
PCT Pub. Date: May 26, 2016

(65) Prior Publication Data

US 2017/0314338 A1 Nov. 2, 2017

(30) Foreign Application Priority Data

Nov. 17, 2014 (SE) ..... 1451380

(51) Int. Cl.
*E21B 17/06* (2006.01)
*E21B 31/18* (2006.01)
(Continued)

(52) U.S. Cl.
CPC ..... *E21B 17/06* (2013.01); *E21B 31/18* (2013.01); *E21B 33/12* (2013.01); *E21B 29/00* (2013.01)

(58) Field of Classification Search
CPC ..... E21B 17/06; E21B 33/12; E21B 31/18; E21B 29/00; E21B 29/10; E21B 23/00; E21B 23/02
See application file for complete search history.

(56) References Cited

U.S. PATENT DOCUMENTS 3,278,219 A 10/1966 Elliston
3,865,408 A 2/1975 Young

FOREIGN PATENT DOCUMENTS

EP 0418056 A1 3/1991

OTHER PUBLICATIONS

Colombian Office Action of Application No. NC2017/0004367 in 12 pages.

(Continued)

*Primary Examiner* — Wei Wang
(74) *Attorney, Agent, or Firm* — Knobbe, Martens, Olson & Bear, LLP

(57) ABSTRACT

The present invention relates to a re-connecting device (1) for connecting and sealing against a damaged existing/remaining tubing (5) in a well bore, a casing string (2) or a pipe, the tubing (5) having smaller diameter than the casing string (2), and for repairing of the tubing (5), comprising an outer body (3) and at least one sealing element (18) arranged therein, the outer body (3) is arranged to enable the entrance of, and surrounding, the end part of the tubing (5) in the well bore, casing string (2) or pipe, and a sealing assembly (8) is arranged in the outer body (3), of the re-connecting device (1), for sealing it against the tubing (5). The invention is achieved by that an internal and axially movable assembly (Continued)

(6) is arranged inside the outer body (3) and comprising at least one of an anchoring assembly (7), the sealing assembly (8) and/or a releaseable locking assembly (9), where the movable assembly (6) and at least one of its anchoring assembly (7), sealing assembly (8) and/or releaseable locking assembly (9) is/are arranged to be activated by applying an axial mechanical/physical stroke to the top of the moveable assembly (6).

18 Claims, 6 Drawing Sheets

(51) Int. Cl.

| | |
|---|---|
| ***E21B 33/12*** | (2006.01) |
| ***E21B 29/00*** | (2006.01) |
| ***E21B 17/02*** | (2006.01) |
| ***E21B 29/10*** | (2006.01) |
| ***E21B 31/00*** | (2006.01) |

(56) References Cited

OTHER PUBLICATIONS

Chinese Office Action for Application No. 201580060146.8 dated Sep. 28, 2018 in 21 pages.

RETRIEVABLE RE-CONNECTING DEVICE WITH INTERNAL SEAL AND SLIPS FOR CONNECTING TO THE TOP OF AN EXISTING TUBING IN A WELL BORE

CROSS-REFERENCE TO RELATED APPLICATIONS

This application is the U.S. National Phase under 35 U.S.C. § 371 of International Application PCT/M2015/058870, filed Nov. 17, 2015, which claims priority to Swedish Patent Application No. 1451380-8, filed Nov. 17, 2014. The disclosures of the above-described applications are hereby incorporated by reference in their entirety.

TECHNICAL FIELD

The present invention relates to a retrievable reconnecting device with internal seal and slips for creating a sealed and mechanically fixed connection to an existing tubing or pipe in a well bore. The invention is especially intended for repairing damaged tubing in a well bore in an oil or gas well. The reconnecting device is also intended to create a base for connecting a tubing string above the device once installed in the well, in order to resume the production of oil or gas from the well.

The invention also relates to a method for reconnecting to existing tubing in a well bore for production of oil or gas from the well.

The invention also relates to use of a reconnecting device in a well bore for production of oil or gas from the well.

BACKGROUND OF THE INVENTION

Oil or gas wells are normally built up by a number of bore holes each normally having steel casings in various sizes, with the largest casing diameter closest to the surface, and smaller sizes with increasing depth of the well. In most oil wells a so-called completion is installed in order to produce oil from certain and desired levels or zones in the well. A completion usually consists of a so called packer device by help of which a production zone could be defined/created, allowing production, e.g. by means of a smaller tube/tubing installed inside the casing and leading up to the surface.

The stresses and wear on the components and tubing used in the completion can be very high, both from a thermal point of view, but also purely mechanical in the form of compressive stresses, wear/erosion and from aggressive chemical environments. It is not uncommon that the tubing over time will become damaged by wear or thermal effects and begins to break or leak.

This leaking problem has to be solved before the production of oil can be resumed in full scale. Repairing the tubing can be done e.g. by pulling all tubing out of the well bore and replace the completion. This is a comprehensive task as the tubing can be very long. In many cases the tubing is also permanently installed in the well bore connected to one or more permanent packers. In such cases the completion often has to be drilled out and be exchanged by new equipment. All this will take a lot of time and the operation as well as the new equipment will be very costly. Substantial production time is also lost.

Consequently, there is a need for a system that can minimize the part of the leaking completion that must be replaced, be easily installed, withstand high temperatures and high mechanical erosion and that can be manufactured and installed at a reasonable cost.

OBJECTS OF THE INVENTION

The object of the invention is to provide a solution to the problems mentioned above and suggest a retrievable re-connecting device with internal seal and slips, which allows as much as possible of the already installed completion to stay in the well. This is done by cutting the existing tubing below the leakage/fracture, remove the damaged tubing and install the retrievable re-connector device onto the remaining tubing in the well. By inserting a seal stem to the upper part of the device, production can be restored from the existing tubing, via the device and further up to the surface through the seal stem and the new tubing above it.

Another object with the present invention is to make it possible to mechanically lock the retrievable re-connecting device within the casing, with an anchoring mechanism expanding inwardly, when installed over the top of the remaining tubing.

One further object with the present invention is to provide A retrievable re-connecting device that is retrievable and possible to retract from the tubing and the well bore.

Another object with the present invention is to create a pressure tight sealing, expanding inwardly, from the outer body of the re-connecting device and onto the remaining tubing in the well, so that the production in the well can be resumed.

Another object with the present invention is to create A retrievable re-connecting device that in its upper part contains a seal bore, thereby making it possible to create a sealed extension of the tubing up to the surface.

One further object with the present invention is to provide a retrievable re-connecting device that is easy to install by commonly used setting methods and when located in place the device should be easy to activate.

One further object with the present invention is to provide a retrievable re-connecting device that can be activated by a simple mechanical stroke with a pre-defined stroke and force.

One further object with the present invention is to provide a retrievable re-connecting device that is simple/functional in its design, effective to manufacture and safe in use.

These and further objects and advantages with the invention will be described below.

SUMMARY AND BENEFITS OF THE INVENTION

The invention relates to a retrievable re-connecting device with internal seal and slips, mainly for restoring a partly damaged and leaking tubing that is a part of a completion in a well bore. The re-connecting device is intended to be installed in the well bore and connected to the remaining and intact tubing part in the well, after that the damaged part of the tubing has been cut and removed.

The retrievable re-connecting device is arranged with an outer body preferably of steel forming the fixed part of the re-connecting device. An internal, moveable assembly consisting of an anchoring assembly, a sealing assembly and a release-able locking system is positioned inside the outer body. The anchoring and sealing assemblies are activated by applying an axial stroke to the top of the internal assembly of the device by means of e.g. a hydrostatic running tool that is connected to the upper part of the outer body.

The retrievable re-connecting device is connected to the hydrostatic running tool at surface by a thread in its upper part of the outer body. A corresponding thread in the collet of the hydrostatic running tool connects the two systems, and the extension of the piston of the hydrostatic running tool is set against the top of the fishing neck of the device. The full assembly is run into the well until the mule shoe of the re-connecting device meets the tubing. As the tubing enters the device, the assembly is further lowered until the tubing meets the no-go ring positioned inside the re-connecting device. When the weight applied from the surface increases, fixing elements or shear members, such as shear screws, holding the no-go ring will shear, indicating that the device is in the correct position to be activated (SET)

When activated, the anchoring assembly first secures that the re-connecting device is fixed to the remaining tubing. Secondly, the sealing assembly is set and creates a sealed connection between the tubing and the outer body of the re-connecting device. A number of brass shear screws assembled in different parts of the re-connecting device are used to control the sequence of activating the re-connecting device.

The release-able locking system keeps the internal assembly in the set position, thereby securing the grip and the sealing between the device and the remaining tubing.

The upper portion of the re-connecting device consists of a polished bore receptable (PBR) that after installation of the device can be used to create a sealed extension of the tubing above the device via a seal stem.

If necessary the re-connecting device can be released from the old tubing by means of a pulling tool. A pulling tool can be latched into the internal profile of the fishing neck, and by pulling upwards the release-able locking mechanism will release the internal, moveable assembly in relation to the outer body. By doing this, the sealing assembly will be pulled apart to the original position, and the packer element will contract away from the old tubing. Likewise, the anchoring assembly will be pulled apart to its original position, and the grip to the old tubing will be lost.

The outer body of the re-connecting device consists of two main parts, connected by means of a thread and fitted with a seal between. The lower part of the outer body holds the inner assembly in place, and is fitted with a so called half mule-shoe at its lower end. The mule-shoe works as a counter hold to the moveable inner assembly, making the setting force of the hydrostatic running tool to be transferred through the anchoring assembly and through the seal assembly to the tubing. The half mule-shoe will also guide the device when run in hole, and make the existing tubing enter the re-connecting device as it is lowered down onto the tubing.

The lower part of the outer body is internally fitted with a sealing surface that by o-rings will seal between the packer element mandrel, and with a special thread profile that is used by the lock ring to hold the re-connecting device in its set position when activated.

When the re-connecting device is fully set, the hydrostatic running tool is released from the upper part of the outer body by rotation, making the threads of the collet in the running tool dis-engage with the corresponding thread in the outer body.

The upper part of the outer body will be the receiving end of a seal stem that can be used to connect the re-connecting device to the new production tubing above the device. The upper part of the outer body also holds a thread in its upper portion for connecting the hydrostatic running tool that is used to activate the device.

The lower end of the upper outer body will also function as a "no-go" for the inner assembly during retrieval of the re-connecting device, making the complete device being pulled out by the pulling tool when retrieved.

The internal assembly thus consists of four main systems; a fishing neck, a release-able locking mechanism, a sealing assembly and an anchoring assembly.

The fishing neck is positioned at the top of the moveable internal assembly and has two functions. During activation of the re-connecting device, it transfers the downward axial force from the hydrostatic setting tool through the internal assembly and to the tubing. The lower end of the fishing neck is connected to the release-able locking mechanism, and during activation, the lock ring is pushed down by the fishing neck. During retrieval of the re-connecting device, a pulling tool is latched into the internal profile of the fishing neck, thereby making it possible to apply an upwards axial force to the internal assembly to release the device from the tubing.

The release-able locking mechanism is based on using a splitted lock ring with an external thread, which fits into a corresponding internal thread in the outer body. During activation of the re-connecting device, the lock ring is pushed downwards by the fishing neck. Since the lock ring is splitted it can collapse inwards, thereby "jumping" over the internal threads in the outer body as it travels downwards. When the device is fully set (fully activated), the thread profiles will prevent the lock ring from moving upwards, thereby keeping the internal assembly and the re-connecting device fixed in the activated position. The downward axial force is transferred from the fishing neck, through the crossover sleeve, and further down the internal assembly.

To release the locking mechanism, an upward axial force is applied to the fishing neck. This will further pull on the crossover sleeve, and the brass shear screws that are connected to the lock ring backup will shear. This will make the crossover sleeve move upwards in relation to the lock ring backup. The crossover sleeve is connected through a number of cross links to a conically shaped release cone that will engage with the lock ring. By doing that, the lock ring will be forced to collapse inwards, and the external threads will dis-engage from the threads in the outer body. By doing that, the whole internal assembly can now move upwards in relation to the outer body, and the device can be released from the tubing.

The sealing assembly consists of at least one packer element, a packer mandrel, an axially moveable upper sleeve that will transfer the axial setting force into the packer element, and a lower sleeve fixed to the packer mandrel that will work as a counter hold to the setting force. The movement of the upper sleeve is controlled by a set of shear screws, who will shear at a pre-defined force to allow for the packer element to be set. During setting, the upper sleeve moves downward, thereby forcing the packer element to deform inwards, towards the tubing. The setting force applied by the hydrostatic running tool is dimensioned to deform the packer element so that it creates a full seal between the outer body of the re-connecting device and the old tubing. The packer element is preferably made from an elastomeric or thermoplastic material, or combinations thereof, depending on the application.

The anchoring assembly is positioned at the bottom of the re-connecting device and will secure that the device is firmly anchored to the existing tubing when activated. The anchoring assembly consists of an upper cone, integrated in the lower sleeve of the sealing assembly, a set of spring loaded bi-directional slipses, an inner slips housing and a lower cone integrated in the half mule-shoe. The bi-directional slipses are assembled between the outer body and the inner slips housing, kept in place by the cut-outs in the inner slips housing and forced out towards the outer body by compression springs assembled between the inner slips housing and the slipses.

A set of brass shear screws between the outer body and the upper cone will shear at a pre-defined force and allow the upper slips cone to move axially in relation to the outer body. As the upper slips cone moves downwards, the slipses will be pushed downwards until they meet the lower slips cone, and this will force them inwards towards the tubing. As the setting force increases, the slipses will "bite" into the existing tubing and secure that the re-connecting device is kept anchored after activation.

When the device is to be retrieved, the upper slips cone moves upwards as the complete inner assembly is pulled up by the pulling tool latched into the fishing neck. This will make the slipses to lose their grip to the tubing. The compression springs will also help to force the slipses away from the tubing to release the re-connecting device from the tubing.

The locking mechanism comprises of a splitted lock ring, with an external thread, and a corresponding internal thread in the outer body. The lock ring can travel with the fishing neck during activation of the device by being collapsed inwards radially. The lock ring will pass the internal threads of the body as long as the fishing neck is moving downwards relative to the outer body. Once the device is fully set, the lock ring will prevent the inner assembly from travelling back in the opposite direction. The external thread of the lock ring will be forced towards internal threads in the body, and the vertical portion of the threads will engage with each other to prevent the axial movement. This type of locking system is commonly used in similar down-hole tools and will not be further described.

Further features and advantages of the invention will be apparent from the following, more detailed description of the invention and the accompanying drawings and the claims.

BRIEF DESCRIPTION OF THE DRAWINGS

The invention is described in more detail with reference to non-limiting exemplifying embodiments and with reference to the accompanying drawings, in which.

DETAILED DESCRIPTION OF PREFERRED EMBODIMENTS OF THE INVENTION

FIGS. 1 through 9 illustrates the present invention, a retrievable re-connecting device for restoring damaged tubing in a well. The re-connecting device is intended to be inserted in a well bore and connected to a remaining and intact tubing in the well, after that the damaged part of the tubing has been cut and removed. It is emphasized that the invention is in no way restricted to a retrievable re-connecting device for a specific use, but it can be applied to any application where reconnecting and sealing have to be done, as long as the object of the invention is obtained.

Figure 1:
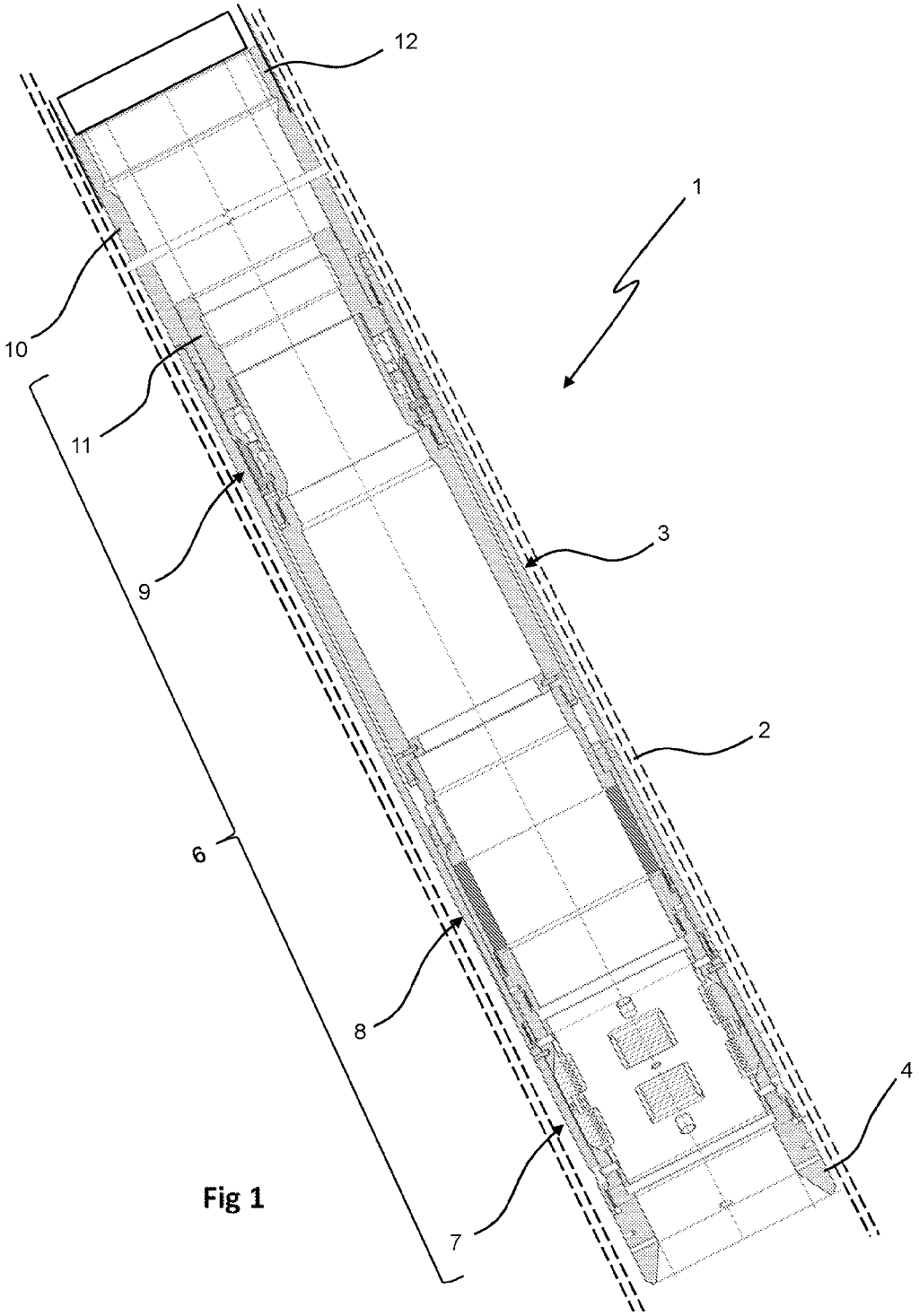
FIG. 1 is a sectioned view of a retrievable re-connecting device, indicated located in a well bore with a casing, according to a first embodiment of the present invention.

FIG. 1 is a sectioned side view of a retrievable re-connecting device 1, here indicated located in a well bore with a casing 2, according to a preferred embodiment of the present invention. The re-connecting device 1 is arranged with an outer body 3, preferably of steel, forming the fixed part of the re-connecting device 1 and arranged with a half mule-shoe 4 with a conical opening in the bottom, intended to enable the entrance of a tubing 5 (see FIG. 2). An internal, moveable assembly 6 consisting of an anchoring assembly 7, a sealing assembly 8 and a release-able locking system 9 is positioned inside the outer body 3. Above the internal movable assembly 6 is arranged a PBR 10, a Polished Bore Receptable, for enabling the extension of the tubing (not illustrated) above the re-connecting device 1, via a seal stem (not illustrated) and up to the surface. The anchoring and sealing assemblies 7-8 are activated by applying an axial mechanical stroke to a fishing neck 11 located at the upper part of the moveable assembly 6 by means of e.g. a hydrostatic running tool (not illustrated) that is connected via a thread 12 arranged in the upper part of the outer body 3.

Figure 2:
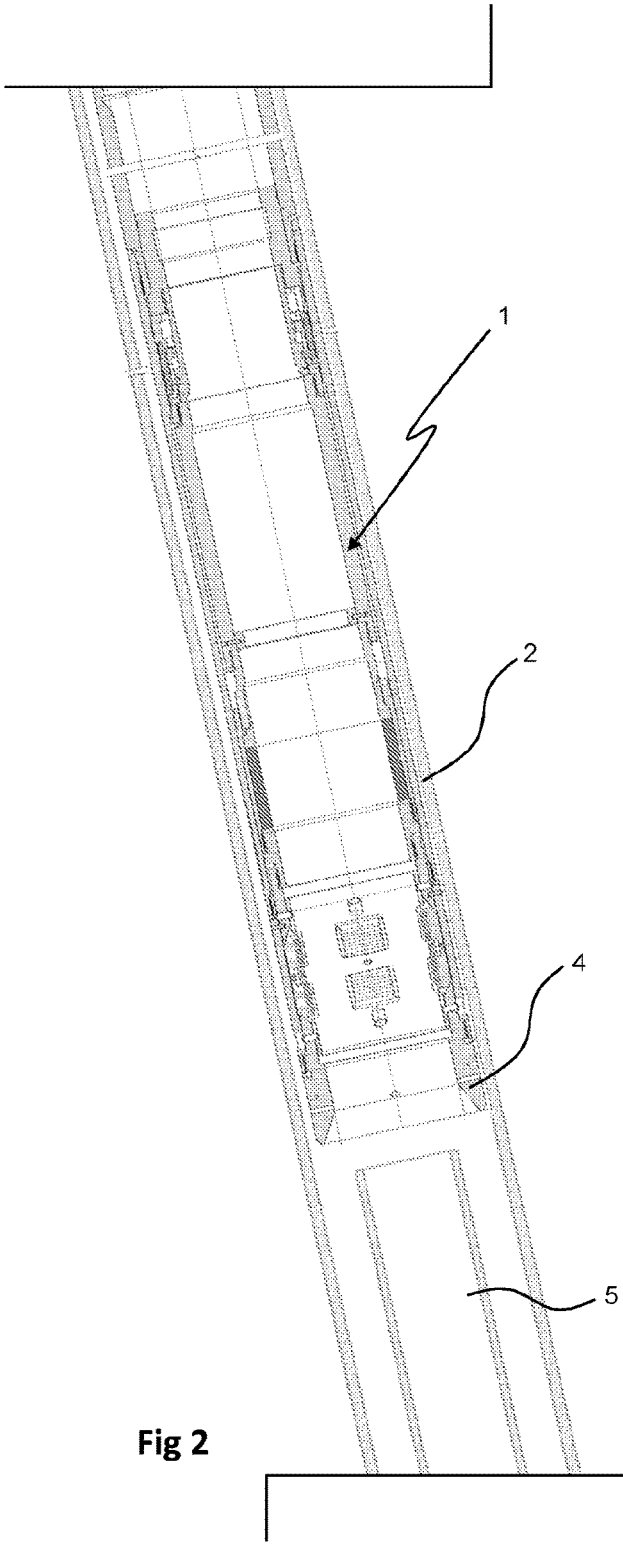
FIG. 2 is a sectioned view of the retrievable re-connecting device run into the well after the tubing has been cut and removed.

FIG. 2 is a sectioned side view of the re-connecting device 1 run into the cased well and down to a remaining tubing 5, after that the damaged part of the tubing has been cut and removed. The re-connecting device 1 is lowered over the existing/remaining tubing 5 until the tubing 5 enters into the device 1 via its conical opening 4 in the bottom.

Figure 3:
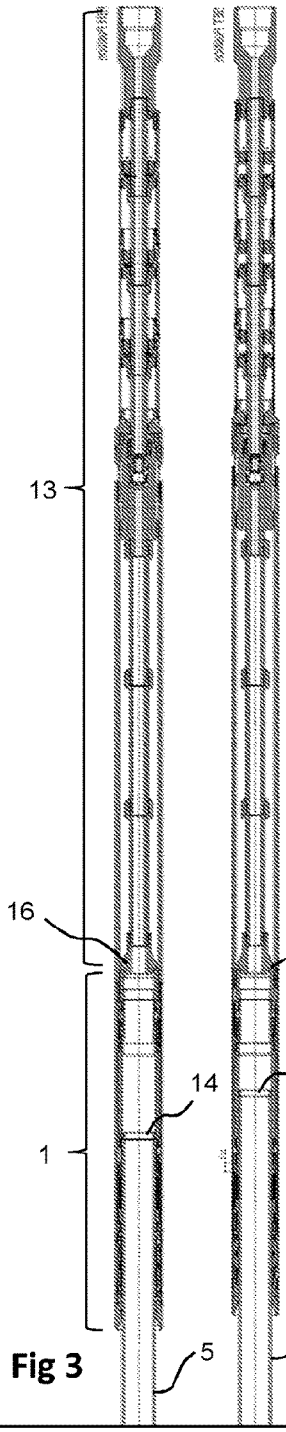
FIG. 3 is an overall sectioned side view of the system with the retrievable re-connecting device with the tubing and running equipment above it in the RIH position.

FIG. 3 is an "all-inclusive" sectioned side view of the system including the tubing 5, the retrievable re-connecting device 1 and the running equipment above it 13. In the figure the re-connecting device 1 is slowly run down over the existing tubing 5 that enters until it stops against a stop ring 14, a "no-go"-ring. The re-connecting device 1 is in this figure not yet activated and thereby not locked in this position.

Figure 4:
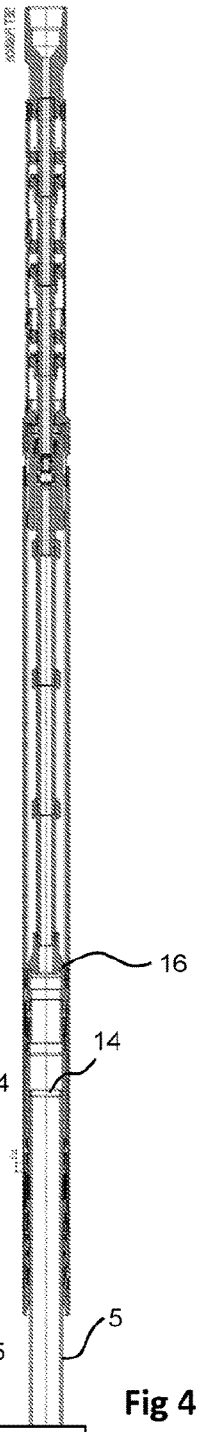
FIG. 4 is an overall sectioned side view of the system with the retrievable re-connection device with the tubing and the running equipment in the SET position.

FIG. 4 illustrates the same view as FIG. 3 but here the re-connecting device 1 is run further down over the tubing 5 and the fixing elements, such as shear screws 15 (see FIG. 5) of the no-go ring 14 (see FIGS. 5 and 6) are sheared. This gives an indication to the operator at the surface that the device 1 is the right position to be activated (SET). The re-connecting device 1 is then pulled up slightly before it is activated. When activated by a setting tool 16, the slipses 17 (see FIG. 9) in the anchoring assembly 7 (see FIG. 5) are set first to secure the grip to the tubing 5 and after that the sealing assembly 8 (see FIG. 5) is set to create a secure seal to the tubing 5. The releasable locking assembly 9 (see FIG. 5) keeps the re-connecting device 1 in the SET position and secures that the setting force is kept on the slipses 17 and the sealing element 18 of the sealing assembly 8. In this position the re-connecting device 1 thus is anchored and sealed to the tubing 5. As can be seen the remaining tubing 5 in the well extends higher inside the re-connecting device 1 in this figure compared to FIG. 3.

Figure 5:
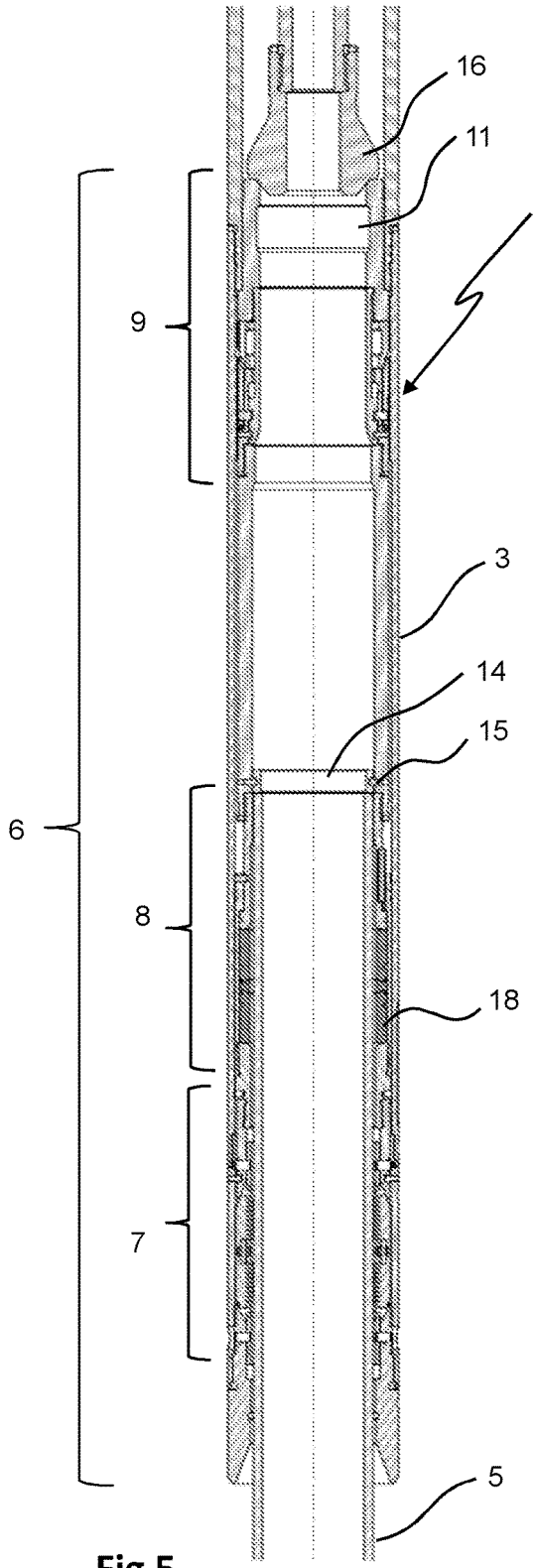
FIG. 5 is a more detailed sectioned side view of the retrievable re-connecting device, in its inactivated position but lowered onto existing tubing in the well.

FIG. 5 is a more detailed sectioned side view of the re-connecting device 1, in its inactivated (RIH) position slowly entered over the remaining tubing 5 until the tubing rests on the no-go ring 14 with its shear screws 15. In the figure is principally illustrated the internal moveable assembly 6 consisting of the three main assemblies 7-9, at the top the release-able locking system 9, in the middle the sealing assembly 8 and at the bottom the anchoring assembly 7, positioned inside the outer body 3. The anchoring and sealing assemblies 7,8 are activated by applying an axial stroke to the top of a fishing neck 11 in the device 1 by means of e.g. a hydrostatic running tool 16 connected to the upper part of the outer body 3.

Figure 6:
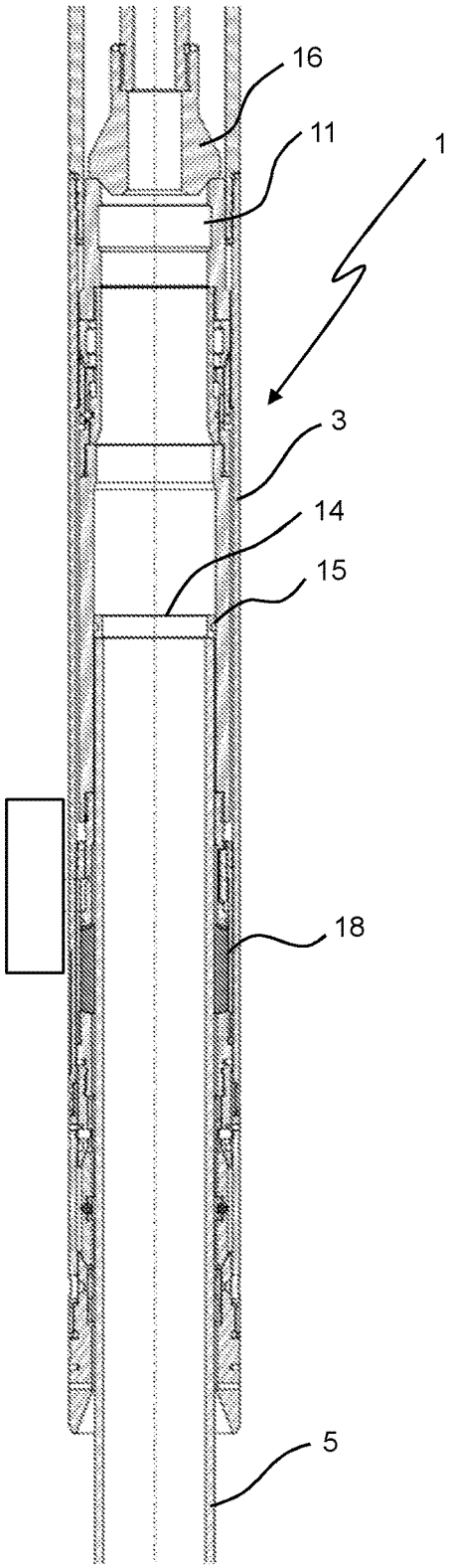
FIG. 6 is a more detailed sectioned side view of the re-connecting device, in its activated SET position to the existing tubing.

FIG. 6 is a more detailed sectioned side view of the re-connecting device 1, in its activated SET position on the tubing 5. In this figure the shear screws 15 in the no-go ring 14 have sheared, thereby assuring that the device 1 is in the correct position. After that, the re-connecting device 1 is activated by the hydrostatic running tool 16, and the anchoring- and sealing assemblies 7,8 are forced inwards towards the tubing 5.

Figure 7:
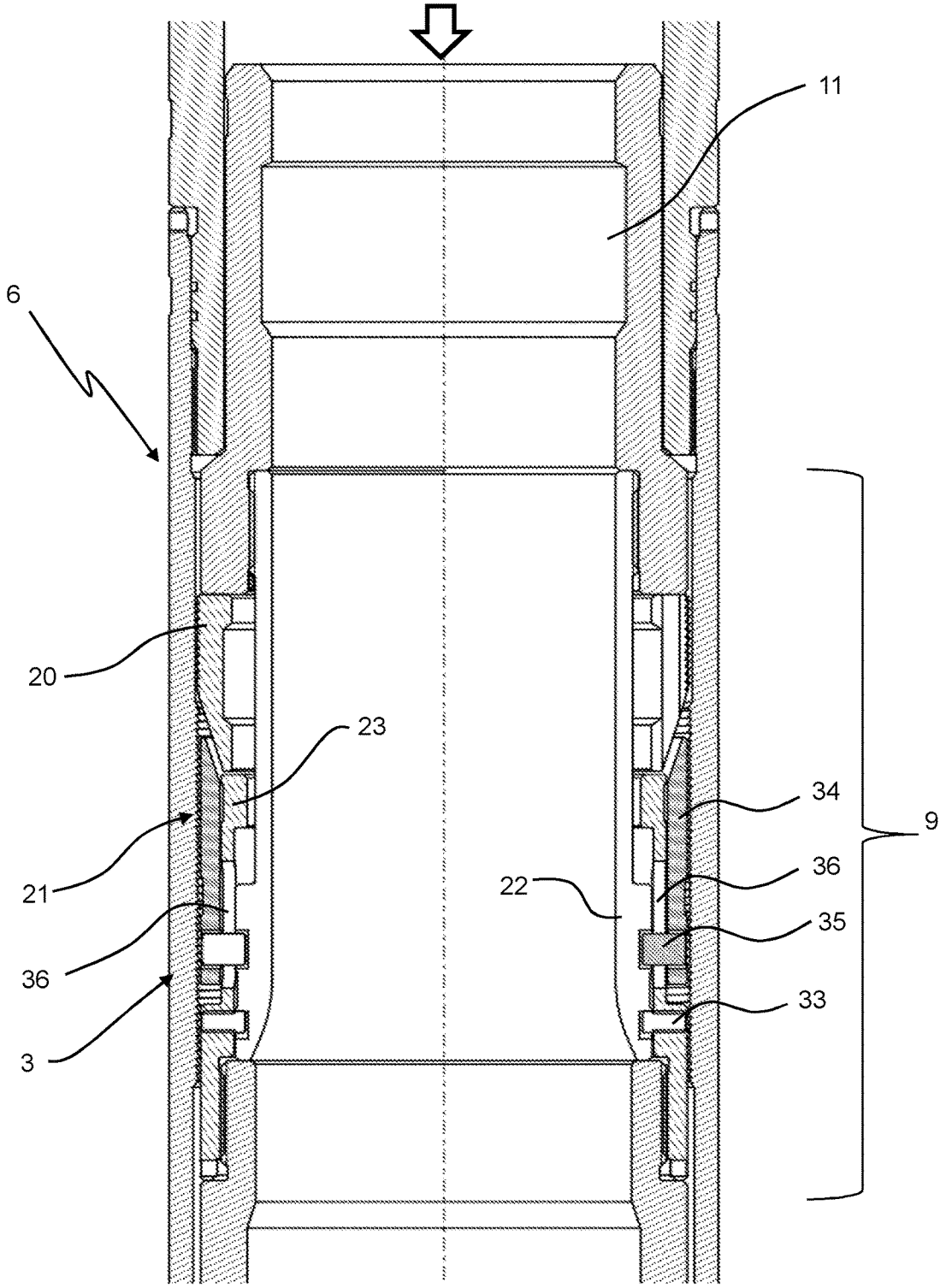
FIG. 7 is a further detailed sectioned side view of the upper part, the releasable locking assembly, of the re-connecting device in its inactivated position.

FIG. 7 is a further detailed sectioned side view of the upper part of the movable assembly 6, the releasable locking assembly 9, of the re-connecting device 1 in its inactivated (RIH) position. The force from the running tool 16 (see FIG. 6) will push downwards on the fishing neck 11 (see arrow). A lock ring 20 travels down during activation, pushed by the fishing neck 11. The lock ring 20 is able to "collapse" inwards since it is axially splitted/cut and "jumps" over internal threads 21 in the body 3 on its way down. The force is further transferred down through the crossover sleeve 22.

When the re-connecting device 1 is activated, an upward reaction force from the compressed sealing element 18 (see FIG. 8) will be transferred through the lock ring backup 23 to the lock ring 20. This will be stopped from moving upwards by the internal threads in the body.

The locking assembly 9 may be released by means of a standard pulling tool (not illustrated) that is latched into the internal profile of the fishing neck 11. When the fishing neck 11 is pulled upwards, the fixing element, e.g. shear screws, 33 are sheared at a predefined force, and the crossover sleeve 22 can move upwards in relation to the lock ring backup 23. When the crossover sleeve 22 moves upwards, a release cone 34 also moves upwards by means of the cross links 35, running in axially slots 36 arranged in the lock ring backup 23. When the release cone 34 hits the lock ring 20 the lock ring 20 will collapse inwards, making the threads of the lock ring 20 disengage with the corresponding threads 21 inside the outer body 3. This makes it possible to release the re-connecting device 1 from the tubing 5 (see FIG. 2). As the locking mechanism 9 is pulled upwards, the upper sleeve 24/see FIG. 8) of the sealing assembly 8 will move up and away from the deformed sealing element 18. The sealing element 18 will then partially retract back to its original shape and thereby release from the tubing 5.

Also the anchoring assembly 7 (see FIG. 9) is released in a similar way. The upper cone 29 will move upwards when the re-connecting device 1 is pulled up, the slipses 17 will then have no support or pressure against the tubing 5 as they will be pushed outwards by the compression springs 32.

Figure 8:
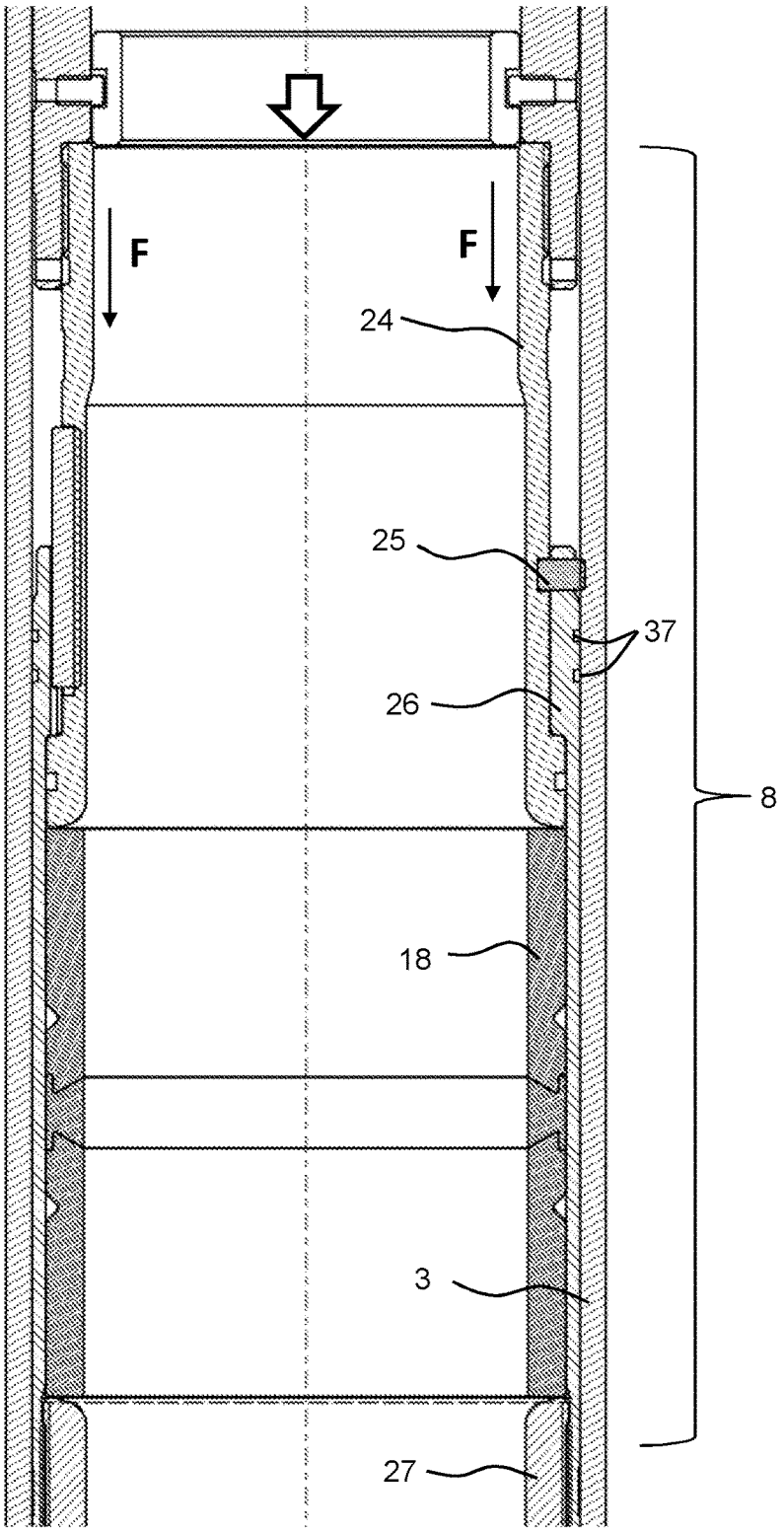
FIG. 8 is a further detailed sectioned side view of the middle part, the sealing assembly, of the re-connecting device in its inactivated (RIH) position.

FIG. 8 is a further detailed sectioned side view of the middle part, the sealing assembly 8, of the re-connecting device 1 in its inactivated (RIH) position. The force from the hydrostatic running tool 16 will push the cross over sleeve 22 and the upper sleeve 24 downwards (see arrow). When the axial force is applied, fixing elements, the shear screws, 25 (e.g. of brass) will shear at a pre-determined force, and the upper sleeve 24 will move downwards in relation to the packer mandrel 26. The movement of the upper sleeve 24 will force the sealing element 18 inwards against the tubing (not illustrated here) and it will be deformed. A lower sleeve 27 acts as a counter hold on the down side of the sealing element 18. A set of O-rings 37 seals between the packer mandrel 26 and the outer body 3 of the device 1, and together with the deformed sealing element 18 this gives a full seal between the tubing 5 and the outer body 3 and the PBR 10.

Figure 9:
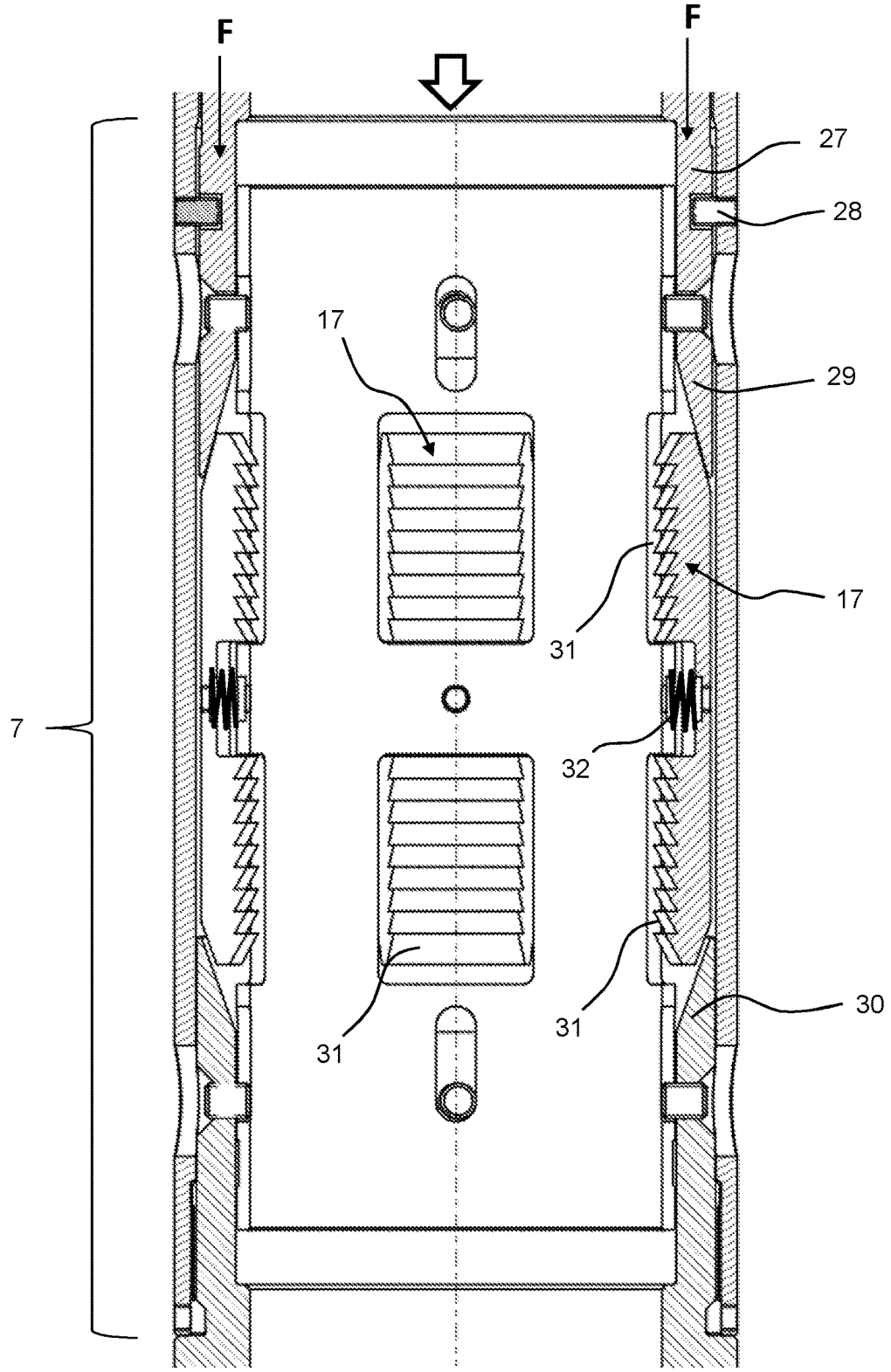
FIG. 9 is a further detailed sectioned side view of the lower part, the anchoring assembly, of the re-connecting device in its inactivated position (RIH).

FIG. 9 is a further detailed sectioned side view of the lower part, the anchoring assembly 7, of the re-connecting device 1 in its inactivated position. The force from the hydrostatic running tool 16 will push the cross over sleeve 22, the upper sleeve 24 and the packer mandrel 26 downwards (see arrow). The shear screws 28 in the lower sleeve 27 will shear at a pre-determined force, and the movement in the lower sleeve 27 will transfer the force to an upper cone 29 which in turn moves downwards pressing on the backside of the slips 17, having matching conically formed surfaces on their backside. The movement of the upper cone 29 also presses the slips 17 against a lower cone 30, arranged below the slips 17. The slips 17, having gripping elements 31 on the inner side facing the tubing (not illustrated), are pushed, against compressing springs 32, inwards against the tubing by the two cones 29,30 until they grip into the tubing.

The whole design of this re-connecting device 1 is made in such a way that the inner diameter (restriction) will not be less in any location inside the device than the inner diameter of the tubing 5. This is also the case for the PBR/sealed extension that may be applied on top of the re-connecting device 1 to provide a production tubing up to the surface.

The fixing elements 28 are firstly sheared during activation in order to set the anchoring assembly 7, for connecting to the tubing 5. The fixing elements 25 are secondly sheared during the activation to expand the sealing assembly 8. The fixing elements 33 are sheared when the device is disconnected from the tubing and the fixing elements 15 are used only for locating the device onto the tubing 5.

I.e. the fixing elements 25,28 and 33 are used to keep everything in place before activation of the device. During activation the fixing elements 28,33 are sheared. During retrieval the fixing elements 25 are sheared.

The above description is primarily intended to facilitate the understanding of the invention. The invention is of course not limited to the above embodiments but also other variants of the invention are possible and conceivable within the scope of the invention and the appended claims. The invention is of course possible to use in other applications not mentioned here.

The invention claimed is:

1. A re-connecting device for connecting and sealing against a damaged existing/remaining tubing in a well bore or a casing string or a pipe, the tubing having smaller diameter than the well bore, the casing string, or the pipe, and for repairing of the tubing, the re-connecting device comprising:

an outer body and at least one sealing element arranged therein, wherein the outer body is arranged to enable the entrance of, and surrounding, the end part of the tubing in the well bore or the casing string or the pipe, and a sealing assembly being arranged in the outer body, of the re-connecting device, for sealing it against the tubing, and said sealing assembly comprising the at least one sealing element, wherein an internal and axially movable assembly is arranged inside the outer body and comprises an anchoring assembly, the sealing assembly and a release-able locking assembly, wherein the anchoring assembly is configured for securing that the re-connecting device is firmly anchored to the tubing when activated, and wherein the movable assembly and at least one of its anchoring assembly and sealing assembly is/are arranged to be activated by applying an axial mechanical/physical stroke to the top of the moveable assembly, and wherein a connecting device, a fishing neck, is arranged in the upper end of the movable assembly, and by pulling the locking assembly upwards, fixing elements are sheared at a predetermined force and the re-connecting device is released from the tubing, thereby making the re-connecting device retrievable from the well bore, the casing or the pipe.

2. The re-connecting device according to claim 1, wherein a polished bore receptable, a PBR (10), is arranged in the upper part of the outer body, above the movable assembly, creating a receiving end for a seal stem, for creating a sealed extension of the tubing and making it possible to extend the tubing to the surface.

3. The re-connecting device according to claim 1, wherein the fishing neck is arranged in the upper part of the movable assembly, arranged to transfer the axial setting force from a running tool, through the re-connecting device and further to the tubing.

4. The re-connecting device according to claim 3, wherein the running tool is a hydrostatic running tool connected via a thread arranged in the upper part of the outer body.

5. The re-connecting device according to claim 1, wherein the said fishing neck has an internal profile in its upper part, so that a pulling tool can be attached to the fishing neck.

6. The re-connecting device according to claim 1, wherein a plurality of fixing elements are arranged to keep the different parts of the movable assembly fixed in relation to each other, in the re-connecting device's inactivated RIH position.

7. The re-connecting device according to claim 6, wherein the fixing elements are arranged to control the sequence of activation of the movable assembly and its different internal systems/parts.

8. The re-connecting device according to claim 6, wherein the plurality of the fixing elements are arranged symmetrically around the parts of the movable assembly.

9. The re-connecting device according to claim 6, wherein said fixing elements are adapted to shear when an axial force reaches a predetermined level that exceeds the total shear value of the installed fixing elements.

10. The re-connecting device according to claim 6, wherein the fixing elements are shear screws.

11. The re-connecting device according to claim 10, wherein the fixing elements are made of a metal, such as steel.

12. The re-connecting device according to claim 10, wherein the fixing elements are made of brass.

13. The re-connecting device according to claim 1, wherein the sealing element in the sealing assembly is ring formed and located around the inside of the outer body.

14. The re-connecting device according to claim 1, wherein the sealing element is arranged to expand inwards against the tubing when pressed from above by an upper sleeve.

15. The re-connecting device according to claim 1, wherein an end stop, a lower sleeve, is arranged on the lower end side of the sealing element.

16. The re-connecting device according to claim 1, wherein the sealing element is made of a flexible/resilient material.

17. The re-connecting device according to claim 1, wherein the sealing element is made of one selected from the group consisting of elastomeric material, a thermoplastic material, a graphite composite material, rubber, and combinations thereof.

18. A method for activating a re-connecting device according to claim 1 comprising:

locating the re-connecting device and the sealing assembly located therein over a remaining part of the tubing in the well bore, in the casing string or in the pipe, providing the axial mechanical/physical stroke at the top of the movable assembly, and displacing thereby the anchoring assembly and the sealing assembly of the moveable assembly axially, resulting in that the sealing element and slips expand radially inwardly in such a way that they anchor the re-connecting device in its current position in relation to the tubing and seals against the surface of the tubing.

* * * * *